United States Patent [19]

Crowle

[11] Patent Number: 4,793,032

[45] Date of Patent: Dec. 27, 1988

[54] SIDE RELEASE BUCKLE

[75] Inventor: William G. Crowle, Deerfield, Ill.

[73] Assignee: Illinois Tool Works, Inc., Chicago, Ill.

[21] Appl. No.: 935,833

[22] Filed: Nov. 28, 1986

[51] Int. Cl.[4] ..... A41F 1/00

[52] U.S. Cl. ..... 24/615; 24/607; 24/616; 24/625; 24/634

[58] Field of Search ..... 24/615, 616, 582, 604–607, 24/633–635, 644, 648, 629, 687, 696, 575–577, 625

[56] References Cited

U.S. PATENT DOCUMENTS

| | | | |
|---|---|---|---|
| 1,099,484 | 6/1914 | Brassler | 24/616 |
| 2,615,736 | 10/1952 | Bergan et al. | 24/575 X |
| 2,622,298 | 12/1952 | Macedo | 24/607 |
| 2,840,878 | 7/1958 | Olson | 24/615 |
| 3,407,453 | 10/1968 | Invernizzi | 24/607 X |
| 3,430,306 | 3/1969 | Tareau | 24/625 X |
| 3,704,492 | 12/1972 | Meredith | 24/634 X |
| 4,559,679 | 12/1985 | Downey | 24/615 |

FOREIGN PATENT DOCUMENTS

| | | | |
|---|---|---|---|
| 779659 | 7/1957 | United Kingdom | 24/575 |
| 8501192 | 3/1985 | World Int. Prop. O. | 24/633 |

*Primary Examiner*—Kenneth J. Dorner
*Assistant Examiner*—Laurie K. Cranmer
*Attorney, Agent, or Firm*—J. P. O'Brien; T. W. Buckman

[57] ABSTRACT

A buckle device comprising separable cooperating receptacle and clasp members and releasable locking means between the receptacle and the clasp. Said locking means includes a through side locking slot and top locking slot in said receptacle and a resiliently supported locking side tab on said clasp engageble with said side locking slot and a second tab on said clasp engageable with said second locking slot. The locking means on said clasp include cam means for disengaging said second tab from said second slot when pressure is applied to said side locking tab of said clasp.

2 Claims, 3 Drawing Sheets

30
16
20
36
38
10
24
28
18
32
34
12
44
43
40
72
52
56
76
79
64
74
77
80
62
58
60
66
67
50
70
68
46
41
82
14

30
20
16
40
82
38
36
76
10
24
14
22
18
32
70
50
34
28

30
24
20
16
36
38
26
32
28
34
22
12
18
79
72
44
43
14
76
74
77
80
62
64
96
98
56
58
52
67
66
60
50
70
68
42
41
40
82

12
16
18
32
34
22

76
46
14
82
67
50
70
68
42
40

SIDE RELEASE BUCKLE

BACKGROUND OF THE INVENTION

This invention relates generally to a buckle, and more particularly to a side release buckle for releasably joining two or three ends of straps for a helmet or the like and including means for simultaneously releasing both sides of the buckle.

Prior art buckles such as generally described in U.S. Pat. No. 4,150,464 includes a separable cooperating receptacle member and a clasp member. The receptacle member includes locking slot means on each side thereof and the clasp member comprises a pair of resilient arms including locking tab means for engaging said locking slot means. The receptacle means and clasp means are released by applying inward pressure on each of said locking tab means. Although, the prior art buckle represents a reliable buckle of relatively simple design for releasably coupling two ends of a belt or the like, inward pressure must be applied to both sides of the buckle to release the cooperating receptacle and clasp members.

When a buckle is used in connection with certain articles such as a helmet or the like, it is sometimes difficult for a user to apply inward pressure to both sides of the buckle. For example, a buckle which is used in connection with a helmet will generally be located directly under the users chin with one side of the buckle pressing against the users chin making it somewhat difficult for the user to reach it and apply pressure thereto.

Accordingly, it is an object of this invention to provide a new and improved buckle for releasably coupling two ends of a helmet or the like which includes means for simultaneously releasing both sides of the buckle.

Another object of this invention is to provide a buckle in accordance with the foregoing object, which is readily molded or otherwise formed from a relatively lightweight material and designed to be rugged and reliable in operation.

A further object of this invention is to provide a buckle which is of relatively simple design with few parts which can be easily and economically manufactured.

SUMMARY OF THE INVENTION

In accordance with the foregoing objects, a buckle according to this invention comprises separable cooperating receptacle and clasp members. The receptacle member includes a hollow body having a top and bottom wall, two opposite side walls, an end wall, and an open-end for receiving said clasp member, and a first and second locking slot means. The clasp member includes a base member with a pair of rigid stop members extending outwardly from opposite ends thereof and spaced apart substantially the distance of said opposite side walls of said receptacle member and first and second arm members spaced between said stop members and extending axially from said clasp member base. The first resilient arm member includes a first locking tab means for substantially simultaneously releasably engaging and disengaging said first locking slot means in the receptacle and a inner wing-like portion defining a first ramp. The second arm member includes an enlarged double wing-like portion with a raised second locking tab for releasably engaging and disengaging said second locking slot means in the receptacle. Said double wing-like portion has an inner edge which defines a second ramp and an outer edge providing a guide. The first arm member is adapted to flex inwardly so that said first ramp releasably engages and disengages said second ramp forcing said second arm member in a downward direction for disengaging said first and second locking tab means of the clasp from the first and second locking slot means in the receptacle.

DETAILED DESCRIPTION OF THE ILLUSTRATED EMBODIMENT

Figure 1:
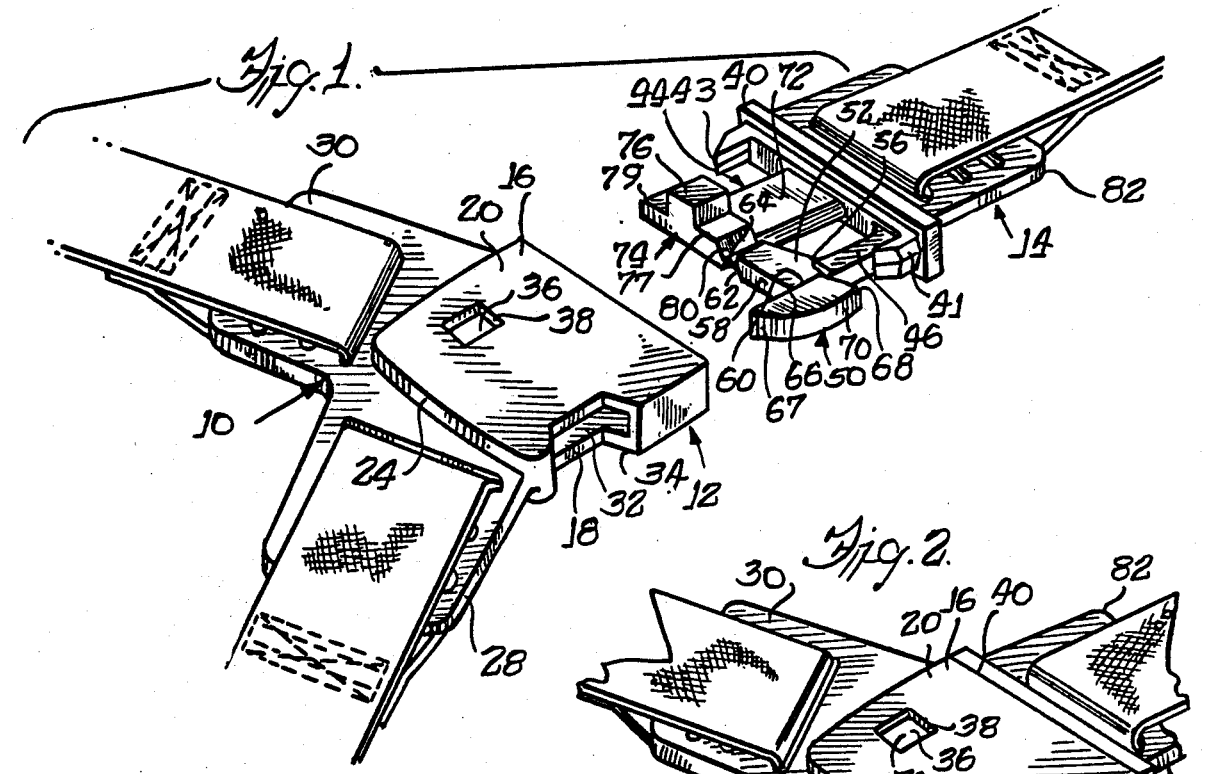
FIG. 1 is an exploded perspective view of the preferred embodiment of this invention showing the separable cooperating receptacle member and clasp member.
Figure 2:
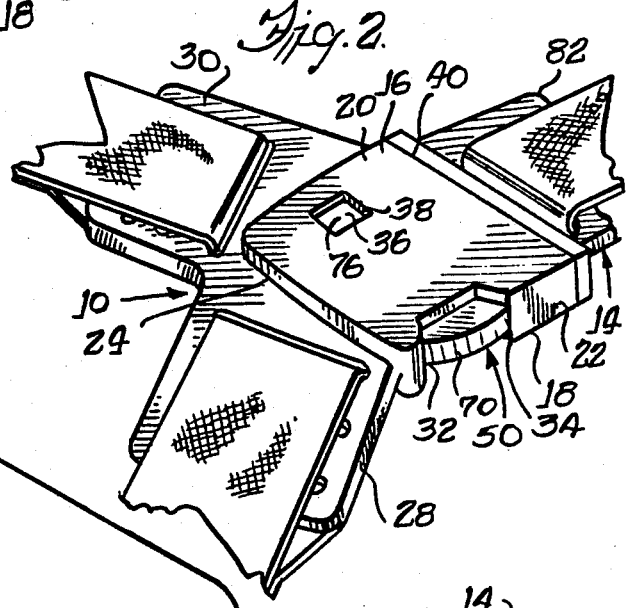
FIG. 2 is a perspective view showing the receptacle member and clasp member as assembled.
Figure 3:
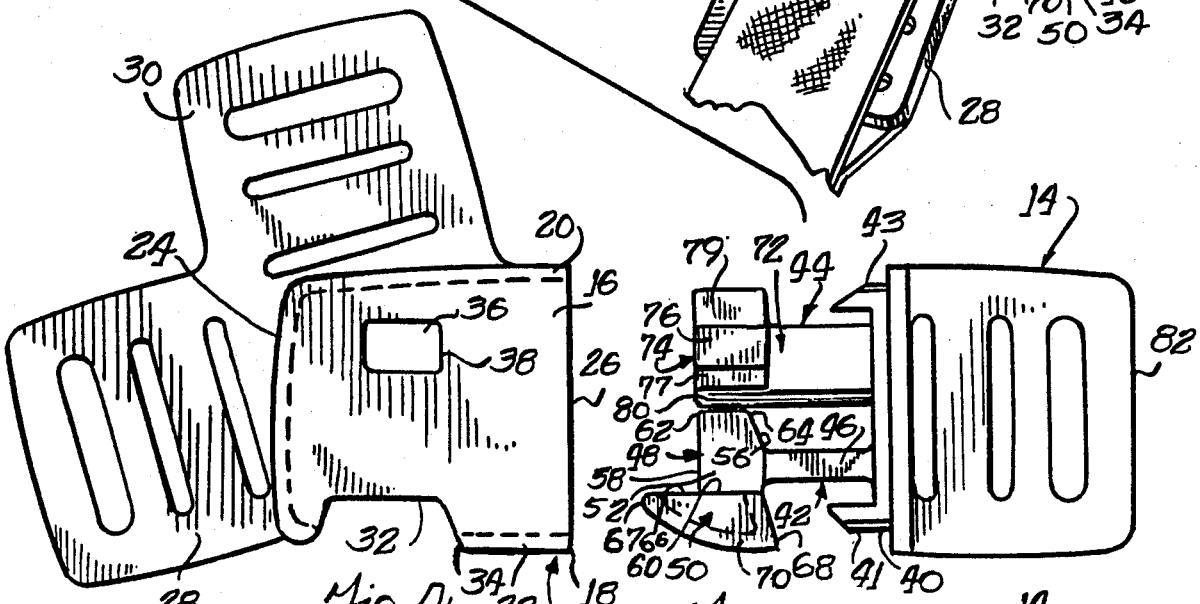
FIG. 3 is an exploded plan view of the receptacle member and clasp member.

Referring now to FIGS. 1 and 3 a buckle 10 shown and includes a separable cooperating receptacle or housing member 12 and a clasp member 14 both preferably made of a tough resilient plastic material. The receptacle 12 and the clasp 14 each include cooperating coupling or locking means for releasably locking the clasp 14 and receptacle 12 together.

The buckle of this invention is particularly suited for use in connection with a helmet but can be utilized in connection with a wide variety of articles. By way of example, but in which no limitation is attached, the buckle 10 can be used in connection with belts, backpacks, life jackets and the like.

As shown in FIGS. 1 and 3 receptacle 12 comprises a generally flat hollow body having top and bottom walls 16 and 18 respectively, two side walls 20 and 22, an end wall 24 and an open-end 26 for receiving the clasp 14. It should be noted that the top and bottom walls 16 and 18 are substantially wider than side and end walls 20, 22 and 24. Strap attachment members 28 and 30 extend outwardly from end wall 24 and side wall 20 respectively. As shown, the ends of straps of a helmet or the like are attached to said strap attachment members by conventional means.

Figure 4:
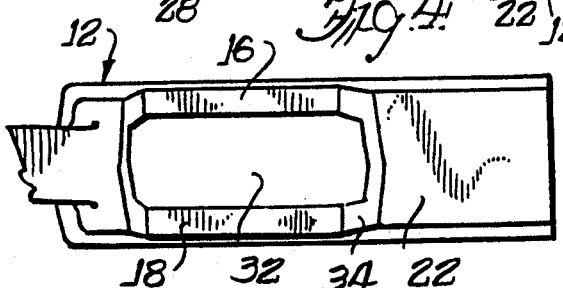
FIG. 4 is an enlarged fragmentary side view of the receptacle member as seen from the bottom of FIG. 3.
Figure 5:
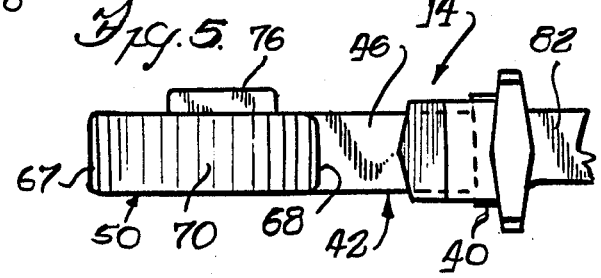
FIG. 5 is an enlarged fragmentary side view of the clasp member as seen from the bottom of FIG. 3.

The receptacle 12 includes two locking or coupling means. As shown best in FIG. 4 the first locking means comprises a through side locking slot 32 which extends into side wall 22 and marginally into the top and bottom walls 16 and 18, forming a locking edge or stop member 34.

The second locking means comprises a top locking slot 36 of substantially rectangular shape extending through top wall 16 and forming a locking edge or stop member 38.

The clasp 14 comprises a base portion 40 which has two rigid stop or guide members 41 and 43 located at opposite ends thereof and extending axially therefrom. The stop members 41 and 43 are spaced apart substantially the extent of the opposite side walls 20 and 22 of the receptacle 12 so that when the clasp 14 is inserted into said receptacle 12 the stop members 41 and 43 engage the inner margins of the side walls 20 and 22.

First and second arm members 42 and 44 extend axially from the base portion 40 of the clasp 14. The arms 42 and 44 are spaced between the stop members 41 and 43.

Figure 10:
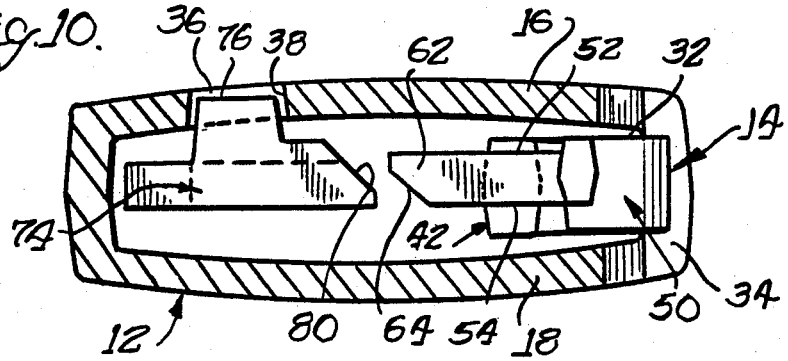
FIG. 10 an enlarged sectional view taken along lines 10—10 of FIG. 6.

Arm 42 comprises a resilient relatively narrow body portion 46 and an enlarged inner free edge or wing-like portion 48 with an outer side locking tab portion 50 connected to said inner wing portion 48. The inner wing portion 48 and tab portion 50 extend laterally in opposite directions from said arm 42. As shown best in FIGS. 11 and 12 resilient arm 42 is adapted to flex inwardly toward the second arm member 44 during assembly and disassembly. As shown in FIGS. 1, 3 and 10 the inner wing portion includes top and bottom walls 52 and 54, two side walls 56 and 58 and an end wall 60 and inner edge 62. The width of the inner wing portion 48 decreases at inner edge 62 to define a cam surface or ramp 64. The side locking tab portion 50 includes a side wall 66 which is to end wall 60 of the inner wing portion 48, and two end walls 67 and 68 and a curved wall or guide portion 70. The guide 70 assists in the insertion and removal of the clasp member from the receptacle member. Locking tab 50 is adapted to slide through the locking side slot 32 of the housing member 12 in assembly.

The arm 44 comprises a body portion 72 which is substantially wider and thinner than body portion 46 of arm 42 and is therefore substantially more rigid in a lateral direction than arm 42. Arm 44 is adapted to flex or be displaced downwardly as shown best in FIGS. 11 and 12.

Figure 11:
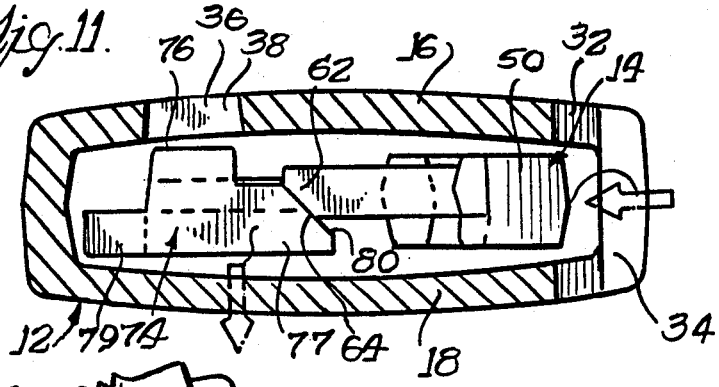
FIG. 11 is an enlarged sectional view taken along lines 11—11 of FIG. 12 showing the ramp portion of the first arm member engaging the ramp portion of the second and FIG. 12 is a reduced plan view showing the method for releasing the clasp member from the receptacle member.
Figure 12:
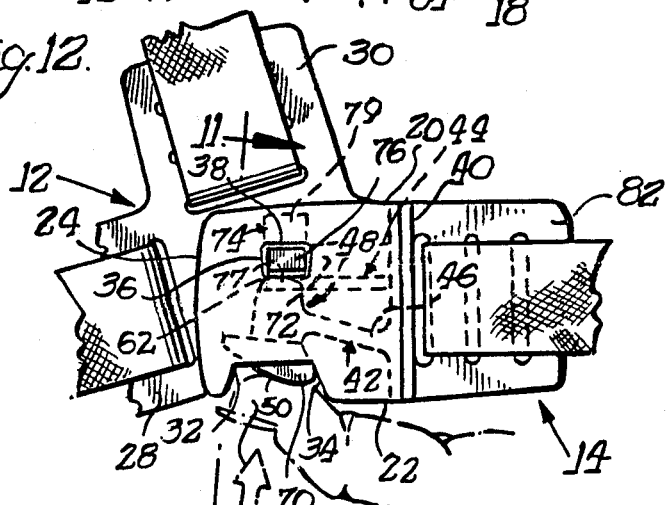

The body portion 72 of arm member 44 has an enlarged double wing-like portion 74 extending laterally therefrom with an inner free edge 77 and an outer free edge 79. The enlarged wing-like portion 74 has a raised or top locking tab 76 of substantially rectangular shape. As shown best in FIGS. 9, 10 and 11 locking tab 76 is made so that its dimensions are less than the dimensions of top slot 36 in the receptacle 12 so that when the clasp 14 is inserted into receptacle 12 the locking tab can snap into top locking slot 36. Outer free edge 79 serves as a guide member for the clasp 14 as it slidingly enters and leaves the receptacle member 12. The width of the inner edge 77 is reduced to define a cam surface or ramp 80 as shown in FIGS. 10 and 11. In operation, ramp 64 of arm 42 engages ramp 80 of arm member 44 as shown in FIGS. 11 and 12 to depress the locking tab 76 when the tab 50 is flexed inwardly during assembly or disassembly of the clasp and receptacle as described below.

A strap attachment member 82 extends axially from base 40 of clasp 14, in the opposite direction from said arms 42 and 44. The ends of straps of a helmet or the like are secured to this strap attachment means by conventional manner.

Figure 6:
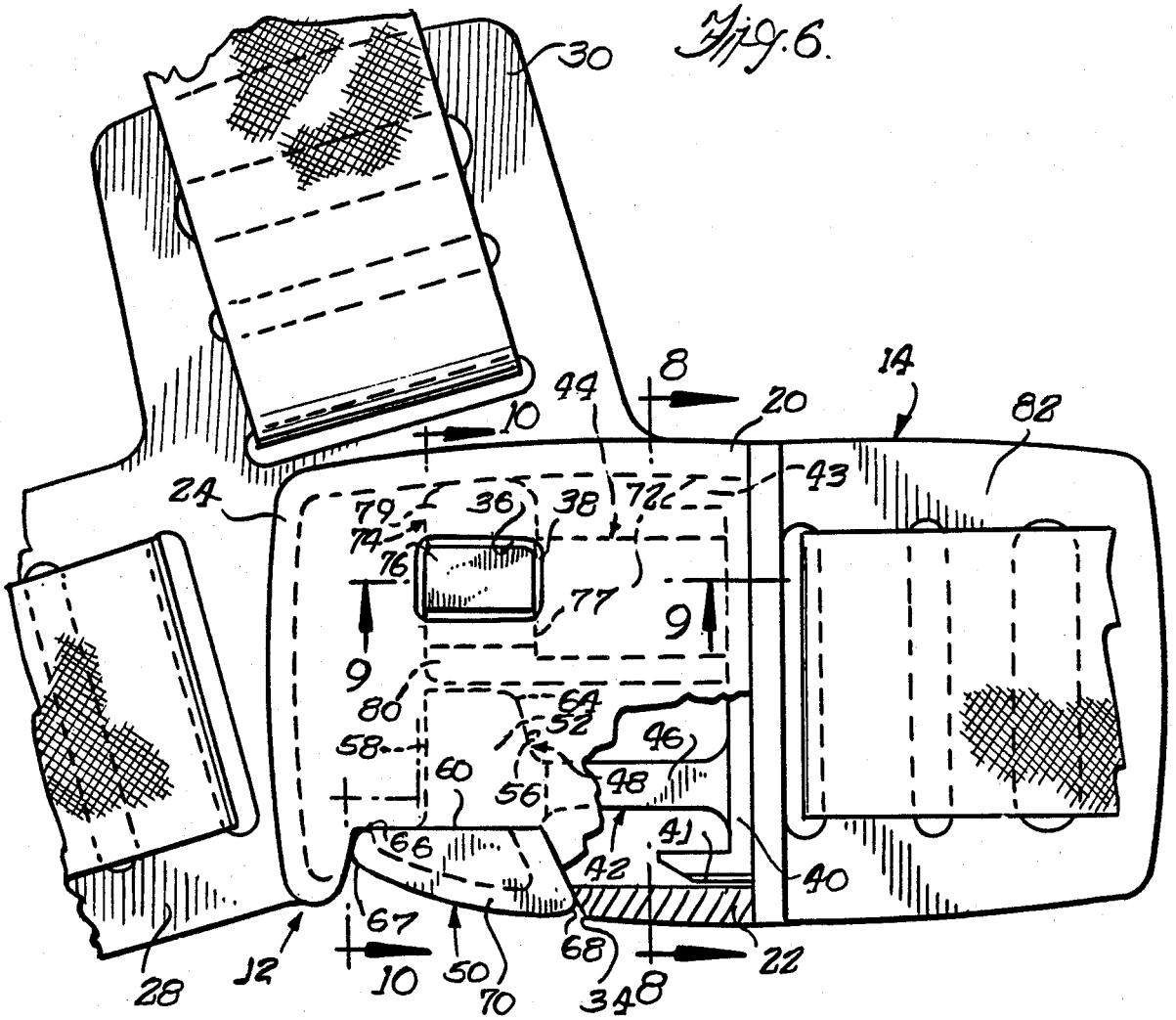
FIG. 6 an enlarged plan view showing the receptacle member and clasp member assembled.

As shown in FIG. 6 the clasp 14 may be readily inserted into open-end 26 of the receptacle 12. The length between the curved wall or guide 70 of locking tab 50 and outer free edge 79 of enlarged wing portion 74 is substantially the same as the inner margin of the open-end 26 of receptacle 12. As the clasp 14 is inserted into the open-end 26 of the receptacle 12 the guide portion 70 add outer edge 79 slidingly engage the inner sides of side walls 20 and 22 of receptacle 12. As shown in FIG. 11 as the guide portion 70 of the locking tab 50 presses against the inner margin of the side wall 22 it forces the resilient arm 42 to flex inwardly toward arm 44 so that ramp 64 of arm 42 engages ramp 82 of arm 44 forcing arm 44 to flex or be displaced in a downward direction.

Figure 7:
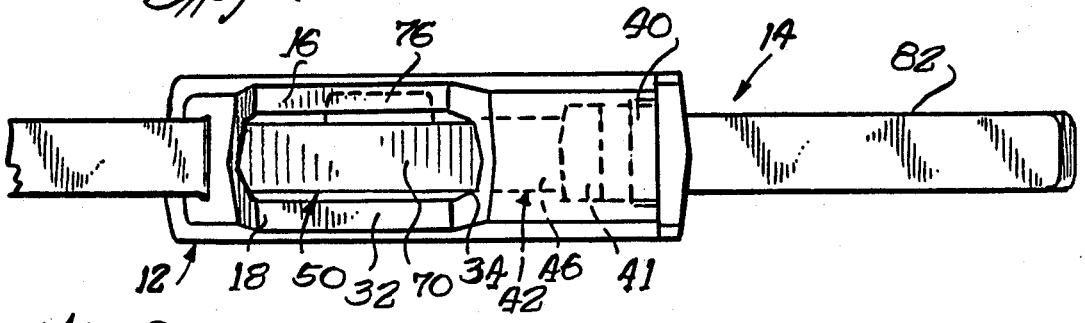
FIG. 7 is an enlarged fragmentary side view as seen from the bottom of FIG. 6.
Figure 8:
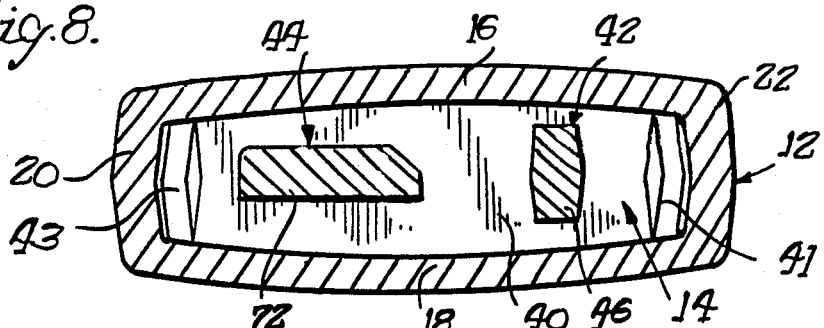
FIG. 8 is a sectional view taken along lines 8—8 in FIG. 6.
Figure 9:
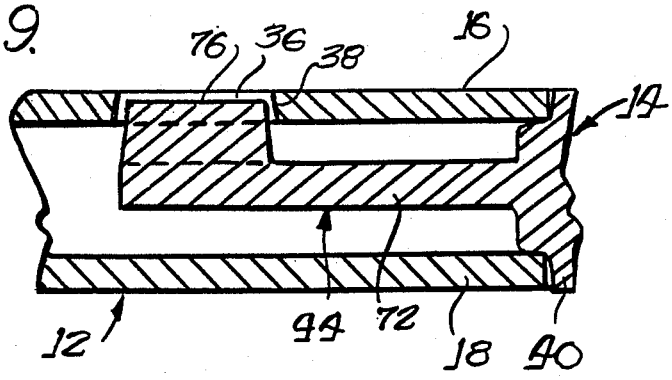
FIG. 9 an enlarged sectional view taken along lines 9—9 of FIG. 6.

Turning to FIGS. 6 and 7 as the clasp 14 slides further into the receptacle 12 locking tab 50 snaps into side locking slot 32 of the receptacle 22 and engages locking edge 34 of side wall 22 of receptacle 12 thereby locking the clasp 14 and receptacle 12 together. In addition, as shown in FIGS. 9 and 10 as locking tab 50 snaps into side slot 32, arm 42 springs or snaps back to its original configuration thereby disengaging ramp 64 of arm 42 from ramp 80 of arm 44 and allowing arm 44 to snap back into its original configuration so that the top locking tab 76 snaps into top slot 36 of the receptacle 12 thereby engaging locking edge 38. From the foregoing description and with reference to FIGS. 11 and 12 the method of releasing the clasp 14 from the receptacle 12 is apparent. As shown in FIGS. 11 and 12, the user can apply inward pressure to locking tab 50 with a finger thereby forcing resilient arm 42 to flex inwardly to disengage side locking tab 50 from side locking slot 32 and locking edge 34. The ramp 64 of arm 42 simultaneously engages ramp 80 of rigid arm 44 thereby forcing arm 44 downwardly to disengage top locking tab 76 from top locking slot 36 and locking edge 38, whereby the clasp 14 may be readily removed from receptacle 12 by sliding said clasp 14 in an outward direction.

It should be noted that the one side release capability facilitates easy and fast release of clasp 14 from receptacle member 12 by the user. This can be important in situations in which the buckle device 10 is used in connection with a safety item such as a helmet, in which it is imperative that the user able to release the separable cooperating receptacle 12 and clasp 14 with the utmost ease and speed. This also provides a reliable end readily releasable buckle for a wide variety of items. In addition, the side arm release reduces the number of parts of the buckle device thereby facilitating manufacture.

While a particular embodiment of the invention has been shown and described, it will be obvious to those skilled in the art that changes and modifications of the present invention, in its various aspects, may be made without departing from the invention in its broader aspects. As such, the scope of the invention should not be limited by the particular embodiment and specific construction described herein but should be defined by the appended claims and equivalents thereof.

The invention is claimed as follows:

1. A buckle comprising a separable cooperating receptacle and clasp, said receptacle including a hollow body having an open end for receiving said clasp, and including first and second locking slots extending respectively through a sidewall and adjacent top or bottom wall of said hollow body, said clasp including a base member and first and second arm members extending from said base member in a lateral spaced-apart relation to each other, said first arm member including a first body portion supporting a first wing member and a first locking tab, said second arm member including a second body portion supporting a second wing member and a second locking tab extending in a ninety degree orientation relative to said first locking tab, said first wing member having a first ramp section slating toward said second wing member, said second wing member having a second ramping section slanting towards said first wing member at an angle complementary to the slanting angle of said first ramp section; the cooperating relation between said receptacle and said clasp being such that said first and second locking tabs seat in said first and second locking slots of said hollow body whenever said clasp is fully inserted into said receptacle to provide a latching relationship therebetween and said clasp is unlatched by depressing said first locking tab inwardly of said first aperture a sufficient distance to pass beyond said sidewall and simultaneously causing said first wing member to depress said second wing member through the interaction of said first and second ramp sections to cause said second locking tab to withdraw away from said second locking slot.

2. A buckle as defined in claim 1, wherein said first locking tab includes a curved marginal wall section for guiding said first arm member to flex inwardly as it contacts the inside wall portion of said sidewall of said hollow body.

* * * * *